US006026946A

United States Patent [19]

McCarty, Jr.

[11] Patent Number: 6,026,946

[45] Date of Patent: Feb. 22, 2000

[54] ENHANCED COIN DISCRIMINATION SYSTEMS AND METHODS

[75] Inventor: Richard E. McCarty, Jr., Little Rock, Ark.

[73] Assignee: POM, Inc., Russellville, Ark.

[21] Appl. No.: 09/037,253

[22] Filed: Mar. 9, 1998

Related U.S. Application Data

[60] Provisional application No. 60/040,650, Mar. 10, 1997.

[51] Int. Cl.[7] ..... G07D 5/08; G07D 5/02

[52] U.S. Cl. ..... 194/317; 194/334

[58] Field of Search ..... 194/317, 334, 194/217, 203

[56] References Cited

U.S. PATENT DOCUMENTS

| | | | |
|---|---|---|---|
| 3,587,809 | 6/1971 | Meloni . | |
| 4,267,916 | 5/1981 | Black et al. | 194/317 |
| 4,326,621 | 4/1982 | Davies | 194/319 |
| 4,356,903 | 11/1982 | Lemelson et al. | 194/217 |
| 4,483,431 | 11/1984 | Pratt | 194/334 |
| 4,601,380 | 7/1986 | Dean et al. . | |
| 5,180,046 | 1/1993 | Hutton et al. . | |
| 5,568,855 | 10/1996 | Hoffman et al. | 194/203 |
| 5,687,829 | 11/1997 | Churchman | 194/317 |

FOREIGN PATENT DOCUMENTS

| | | | |
|---|---|---|---|
| 2 077 475 | 5/1980 | United Kingdom . | |
| 2 176 038 | 12/1986 | United Kingdom | 194/334 |

*Primary Examiner*—Robert P. Olszewski
*Assistant Examiner*—Bryan Jaketic
*Attorney, Agent, or Firm*—Robert Groover; Betty Formby

[57] ABSTRACT

A parking meter contains both optical detection elements, to detect the presence and the diameter of inserted coins, and conventional coils which are inductively coupled to a passing coin and which load a RF oscillator. The optical detection information is used to control the sampling of the frequency of the oscillators which are loaded by the metal in the falling coins. This provides a synergistic way to combine optical detection with electromagnetic detection to achieve compact recognition templates which readily perform difficult discrimination. Addition of a temperature compensation algorithm makes the resulting system extraordinarily insensitive to temperature-dependent variation in the permeability of a falling coin.

18 Claims, 17 Drawing Sheets

| COIN POSITION | DIADATA (BINARY) SET IN ISR * 2 | ACTION TAKEN BY ISR 1 AND ISR 3 |
|---|---|---|
| TOP COIL DIAMETER LIGHTS BOTTOM COIL 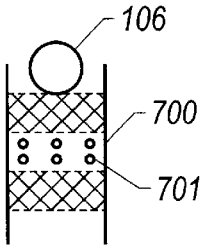  | 00000000<br>1A1 | NONE |
| COIN BREAKS TOP ROW OF LIGHTS 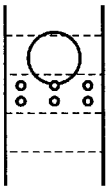 | 00000001<br>1A2 | SAMPLE AND SAVE COIL 1 AND COIL 3 PULSE WIDTHS |
| COIN BREAKS BOTTOM ROW OF LIGHTS 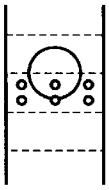 | 00000011<br>1A3 | NONE |
| COIN CLEARS TOP ROW OF LIGHTS 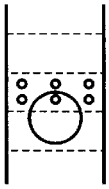 | 00000111<br>1A4 | NONE |
| COIN CLEARS BOTTOM ROW OF LIGHTS 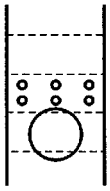 | 00001111<br>1A5 | SAMPLE C1, C3 PULSE WIDTHS AND CALCULATE CONTEXT |
| COIN CLEARS BOTTOM ROW OF LIGHTS 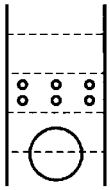 | 00001111<br>1A6 | SAMPLE C1, C3 PULSE WIDTHS AND CALCULATE CONTENT |

FIG. 1A

ENHANCED COIN DISCRIMINATION SYSTEMS AND METHODS

CROSS REFERENCE TO RELATED APPLICATIONS

This application claims priority from Ser. No. 60/040,650, filed Mar. 10, 1997, which is hereby incorporated by reference.

BACKGROUND AND SUMMARY OF THE INVENTION

The present invention relates to coin discrimination operations in electronic parking meters with free-fall coin chutes.

Background: Coin Discrimination

Coin discrimination is a difficult problem. A coin discriminator must be able to distinguish coins from slugs, and must also be able to distinguish between physically similar coins from adjacent countries which may be intentionally or accidentally introduced into a coin slot. For instance, in locations in the northern United States, Canadian coins are often fed into vending machines in place of U.S. coins, and the weight and the dimensions are closely similar to those of U.S. coins.

In conventional operation, multiple coils are used to derive a profile of frequency over time, as the falling coin shifts the oscillator frequency. The frequency-versus-time profiles obtained from the different sensing coils can be combined to derive parameters such as the coin diameter and metallic content. Moreover, the radial variations in coin density can also be extracted from such data. However, a difficulty with such data, in conventional systems, is in derivation of a convenient look-up algorithm for recognition of templates.

Ferromagnetic Coins

A particular problem is posed by coins which are made of a ferromagnetic material, in discriminators which are susceptible to wide temperature variation. This is particularly a problem in Canada (where coins are commonly made of nickel and seasonal temperature variations are wide), but may also be a problem in other countries using ferromagnetic coins (such as Holland) or in other locations where extreme temperature variations occur. Particularly under these extreme conditions, the conventional architecture of using multiple coils which are inductively coupled to the coin's path does not provide sufficiently accurate coin discrimination.

Washers

A problem which is not technologically subtle, but which is nevertheless a persistent nuisance, is the use of mechanical washers as a substitute for coins. Washers can readily be obtained in a variety of diameters and thicknesses, and therefore are very frequently used as coin substitutes. Unsophisticated thieves may simply insert a washer, and therefore one of the desired functions of coin discrimination circuitry is to be able to recognize the presence of the hole in a disc which is inserted into a coin slot.

Background: Free-Fall Coin Chutes

Conventional coin discriminators use a coin chute shape which controls the path of the coin. Typically one edge of the coin will be forced to roll along one edge of the chute by inertial forces or by gravity, so that the relation between spin and velocity of the coin is fixed, and the position of one edge of the coin is also fixed. However, such conventional designs are vulnerable to jamming, since they necessarily require a closely defined spatial relationship in at least some parts of the coin path. Jamming of a conventional coin chute may require disassembly to remove the jam. This is particularly a problem with high security devices, such as parking meters, which must be rugged enough to withstand vandal attacks and hence are necessarily somewhat resistant to disassembly.

Therefore, attempts have been made in recent years to introduce parking meters with "free-fall" coin chutes. Such coin chutes do not force the coin to roll along an edge, but allow it to fall freely. Such coin chutes have a greatly increased resistance to jamming, and if jamming does occur, the coin chute can be cleared much more easily. However, a free-fall coin chute necessarily implies that the spin of the coin will be uncontrolled, and moreover, since different sizes of coins must normally be accepted, the coin may be bouncing unpredictably from one side of the chute to the other, or may be wobbling in a yaw plane during its fall through the chute. Therefore, this simpler mechanical arrangement poses some new difficulties for accurate coin discrimination.

Another trend in modern parking meter operations is to provide meters which do not have a coin return chute. This greatly simplifies the mechanical structure, and hence the reliability, of the vending machine. However, with such a mechanical architecture it is important to never reject valid coins. It is also desirable not to accept invalid coins. Rejection of valid coins will enrage the customer, and may also be used (in the case of parking meters) as a defense against parking meter ticket enforcement. Acceptance of invalid coins will of course reduce the revenue derived from the vending operation.

Detector with LEDs Plus Oscillators

A previous application of POM Inc. (the assignee of the present application) discloses an electronic parking meter system which includes both coil-loaded oscillators and multiple optical emitter/detector pairs for coin recognition. This application (now issued as U.S. Pat. No. 5,360,095, Power Conserving Electronic Parking Meter) is copending (through continuations) with the present application, and is hereby incorporated by reference. The present application presents new modifications and improvements to the systems described in that application.

Enhanced Coin Discriminator

The present application presents a new functional coin discriminator operation. This method of operation is used with coin discriminators which contain both optical detection elements, to detect the presence and the diameter of inserted coins, and it also contains conventional coils which are inductively coupled to a passing coin and which load a RF oscillator.

The present application discloses a coin discriminator in which the optical detection information is used to control the sampling of the frequency of the oscillators which are loaded by the metal in the falling coins. This provides a synergistic way to combine the capabilities of optical detection with the capabilities of electromagnetic detection, to achieve compact recognition templates which readily perform difficult discrimination. The resulting systems can be made extraordinarily insensitive to temperature-dependent variation in the permeability of a falling coin, by using a temperature compensation algorithm in combination with the innovative frequency-sampling methods.

BRIEF DESCRIPTION OF THE DRAWING

The disclosed inventions will be described with reference to the accompanying drawings, which show important sample embodiments of the invention and which are incorporated in the specification hereof by reference, wherein:

FIGS. 1A1–1A6 show various events which occur as a coin passes through a multi-row array of optical detector elements.

DETAILED DESCRIPTION OF THE PREFERRED EMBODIMENTS

The numerous innovative teachings of the present application will be described with particular reference to the presently preferred embodiment (by way of example, and not of limitation), in which:

Hardware Overview

Sample Parking Meter Configuration

Figure 3:
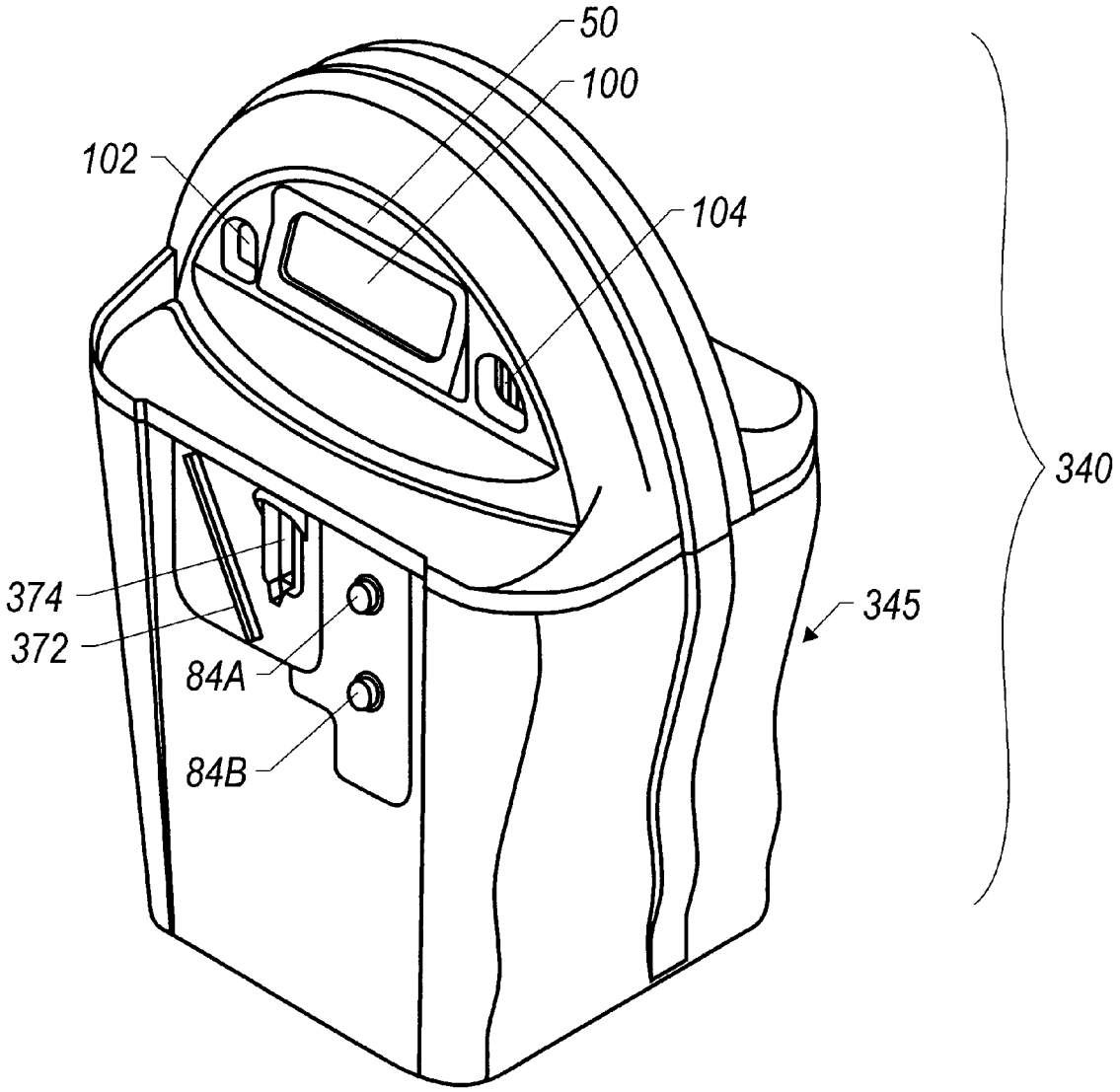
FIG. 3 shows an exterior view of a sample parking meter according to the present invention.

FIG. 3 shows an exterior view of a sample parking meter in which the innovative coin discriminator can advantageously be implemented. This particular meter is a multibay meter, but of course the innovative teachings of the present application can equally well be implemented in a single meter.

This sample meter 340 is especially adapted for two bay operation (i.e., it handles two parking spaces). Preferably meter 340 comprises an exterior casing 345 that protectively houses internal elements. The internal elements include the size detector circuit (FIG. 1B), coin chute 312 (FIG. 4), oscillator circuits, optical detection elements, battery, and a microprocessor and memory as described below.

The buttons 84A and 84B select which parking space time is to be entered for. Display 100 provides an alphanumeric display driven by the microprocessor 301, and windows 102 and 104 provide an indication of expired status for the two spaces controlled. Slot 374 accepts coin payments, and connects directly to the top of the coin chute 312. A slot 372 accepts payments by Smart Card. A transparent window 50 covers the front of the display.

Figure 5:
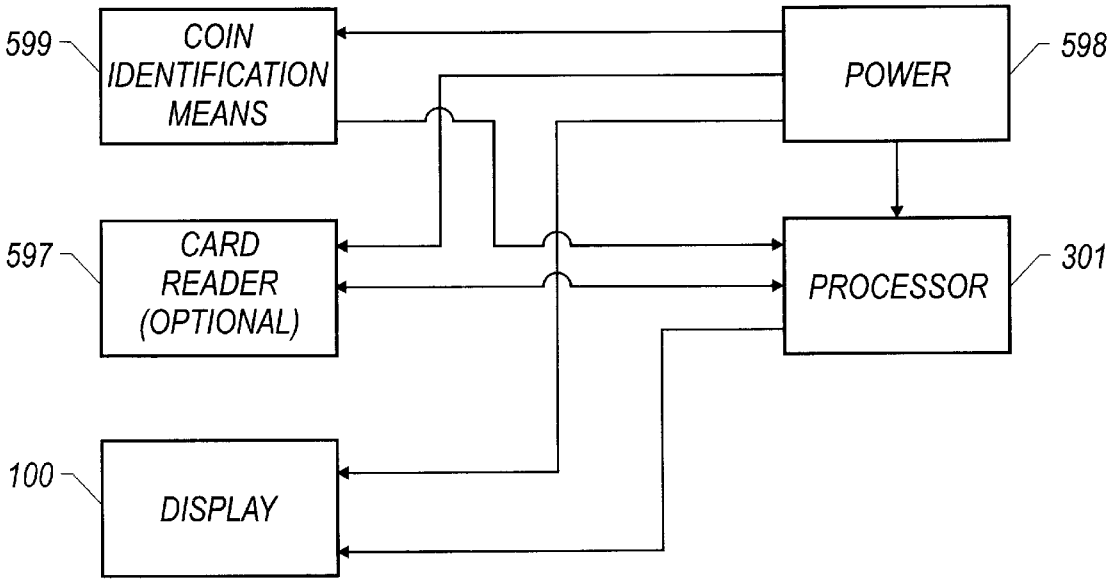
FIG. 5 shows a block diagram of the coin chute and associated coin identifying means.

FIG. 5 shows a high-level block diagram of the sample parking meter embodiment. The processor 301 is powered by power supply 598 (typically a battery), and drives the display 100. The processor receives information from the coin discriminator circuitry 599, and from optional card reader circuitry 597. Additionally, the processor 301 can of course provide control outputs to the oscillators and to the optical connection circuitry.

Sample Free-Fall Coin Chute Configuration

Figure 4:
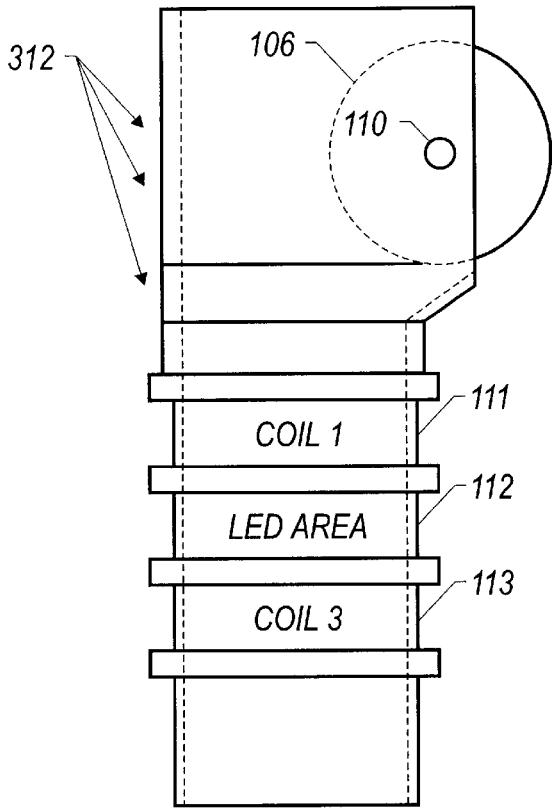
FIG. 4 shows a sample configuration for location of optical detection elements with sensing coils on the coin chute.

FIG. 4 shows a sample configuration of the coin chute. When a coin 106 is inserted into coin chute entry 374 (FIG. 3), it triggers the wake-up emitter/detector pair 110. In the presently preferred embodiment, this pair (and the other emitter/detector pairs) are configured by LEDs (light-emitting diodes) each optically coupled to a corresponding phototransistor. However, of course other emitter/detector configurations are possible.

The coin then falls down through the chute 312. Each coin passes successively through a volume 111 which is coupled to a first coil, an LED area 112 in which two rows of optical emitter/detector elements detect passage of a coin, and a volume 113 which is coupled to another coil (referred to as "coil 3" in this embodiment; there is no "coil 2".) The coin then falls into the cashbox (not shown), since there is no coin return mechanism in this embodiment.

As shown in FIG. 1A, the LED area 112, in this embodiment, includes two rows 700 and 701 of emitter/detector elements. FIG. 1A schematically shows various stages of the positioning of a coin 106 in relation to the top row 700 and the bottom emitter/detector row 701.

Figure 1B:
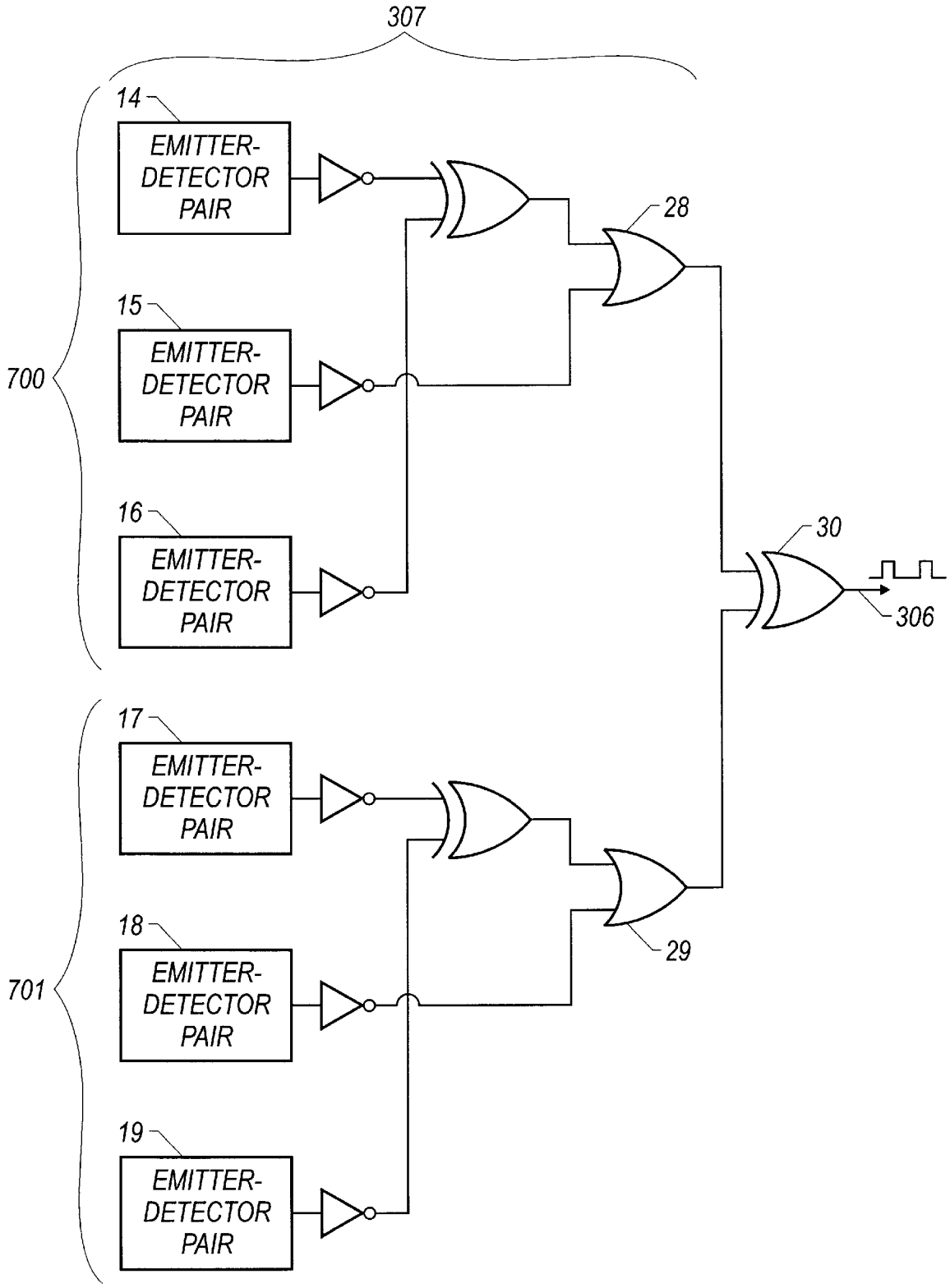
FIG. 1B shows a block diagram of the preferred size detector circuit.

FIG. 1B shows the electrical connections of the outputs from these six emitter/detector pairs, in the presently preferred embodiment. Row 700 includes three emitter/detector pairs 14, 15, and 16, and row 701 includes three emitter/detector pairs 17, 18, and 19. Notice that the two outer LEDs in each of the rows are connected differently from the center LED in each row. The inverted output of top center emitter/detector pair 15 is connected to an OR gate 28, which also sees the XOR combination of the inverted outputs of the top outer emitter/detector pairs 14 and 16. Similarly, the inverted output of bottom center emitter/detector pair 18 is OR'ed with the XOR combination of the inverted output of bottom outer emitter/detector pairs 17 and 19. The outputs of the two OR gates 28 and 29 are then XOR'ed in XOR gate 30, which drives line 306.

The data bits and actions shown alongside the coin positions, in FIG. 1A, will be discussed below in connection with the software which handles these outputs.

Figure 2:
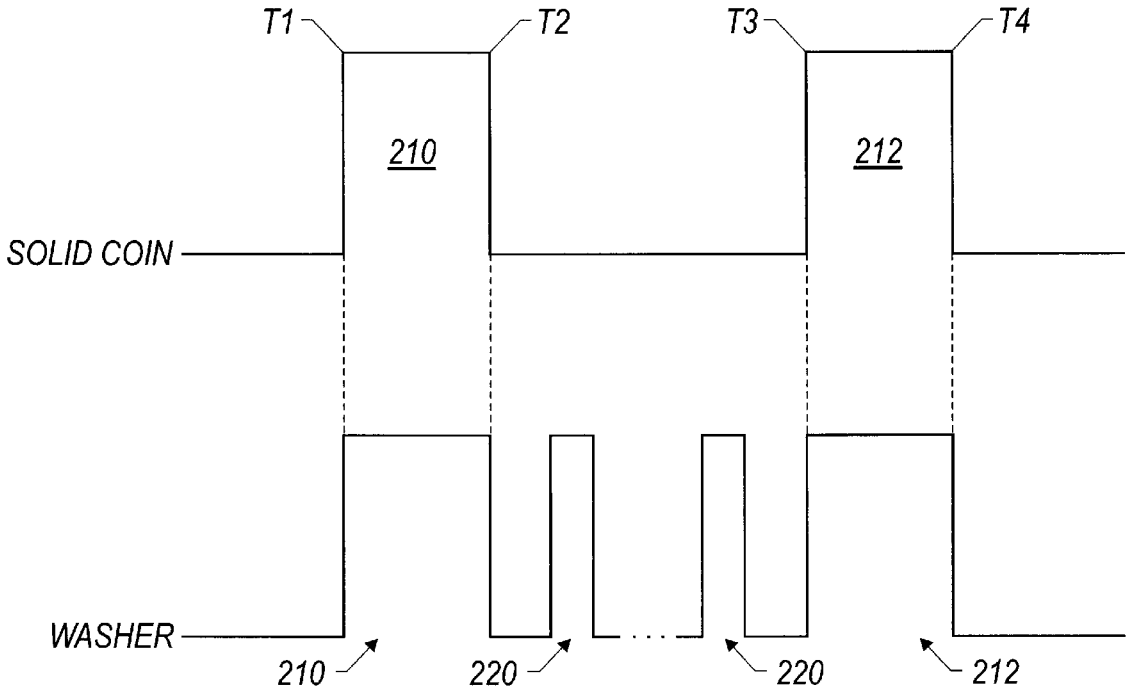
FIG. 2 shows output pulses of size detector circuit using a coin versus a washer.

FIG. 2 is a timing diagram which shows the output of the XOR gate 30 in FIG. 1B. A first pulse 210 will have a rising edge at time T1, when the coin breaks the top emitter/detector row 700, as shown in the second line of FIG. 1A, and will have a falling edge at time T2, when the coin touches the bottom row of lights 701, as shown on the third line of FIG. 1A. A second pulse 212, in the case where a solid coin is passing through the row of lights, will have a rising edge at time T3, when the coin clears the top row 700 of emitter/detector pairs (as shown in FIG. 1A4), and will have a falling edge at time T4 when the coin clears the bottom row 701 (as shown in FIG. 1A5).

Note that the bottom timing diagram of FIG. 2 shows multiple additional pulses 220. The circuitry of FIG. 1B thus provides a very simple washer-detection method: if the "coin" 106 passing through the chute is not solid, its central hole will generate additional pulses 220. These additional pulses 220 permit the software (as described below) to detect the presence of a washer and permit rejection. Washers are not used by sophisticated thieves, but are still frequently used in attempts to defraud parking machines and other vending systems. This very simple circuit configuration solves this problem.

Figure 6A:
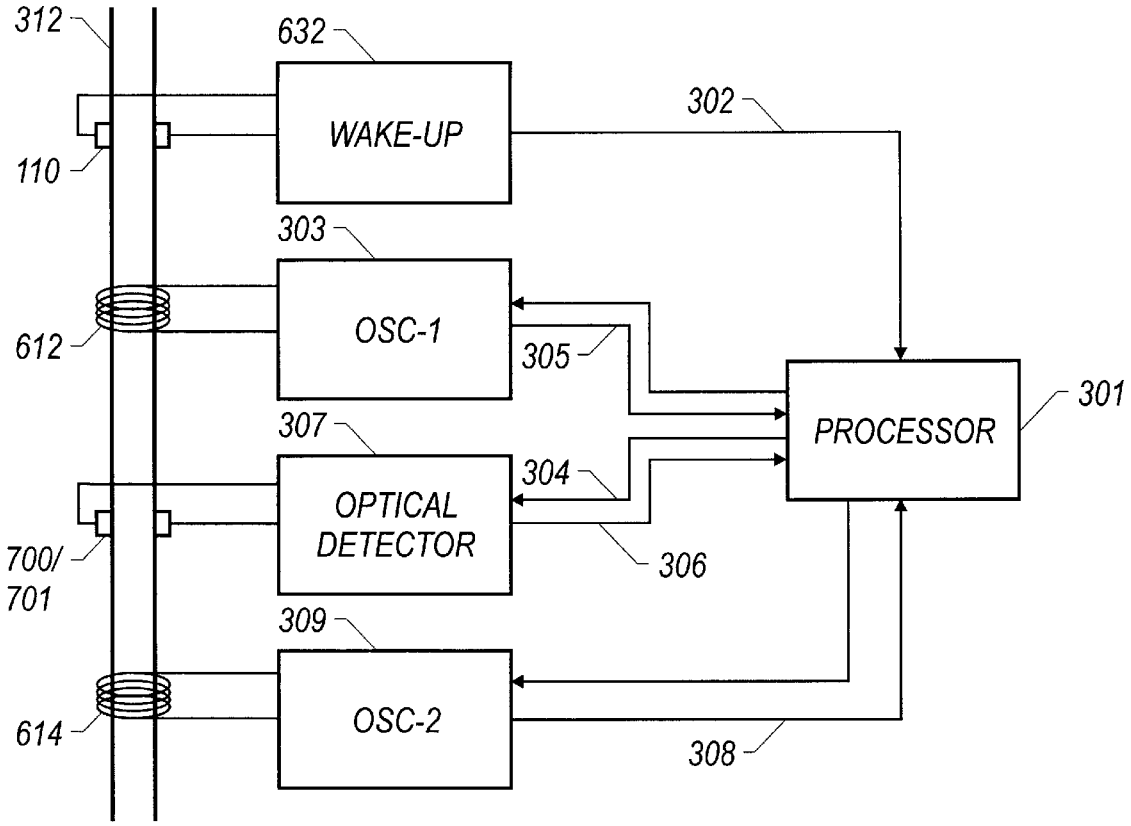
FIG. 6A shows a flow chart of a sample embodiment of the innovative coin discriminating method.

FIG. 6A schematically shows the connection of the different coin sensing inputs to the microprocessor 301. The wake-up emitter/detector pair 110 provides an output to a wake-up circuit 632, which sends an interrupt to the processor 301 on line 302. Upper oscillator 303 is coupled to first coil 612, which is inductively coupled to the interior of the chute in location 111 and provides an output 305 to microprocessor 301. The optical detector circuitry 307 provides an output to processor 301 on line 306, as just described. A second coil, which is coupled to the lower volume 113 in the interior of coin chute 312, loads a second oscillator 309, which also provides an input to the processor 301. Thus coin detection circuitry 599 includes, in this embodiment, wake-up circuitry 632, first oscillator 303, optical detector circuitry 307, and second oscillator 309.

Figure 8A:
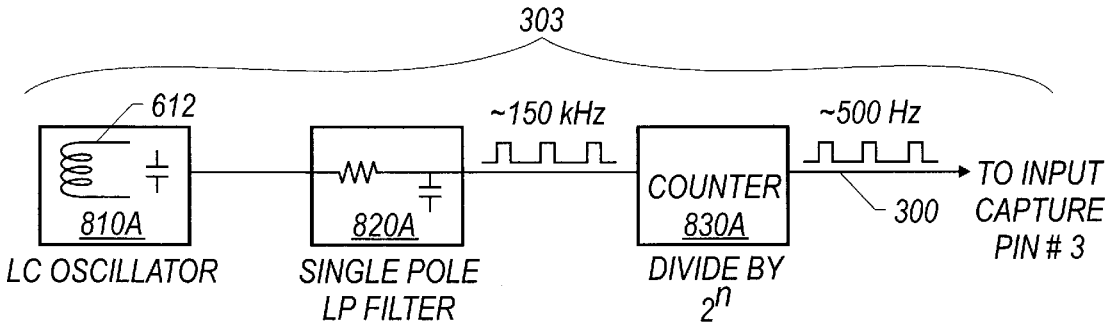
FIGS. 8A and 8B show block diagrams of the oscillator circuitry.
Figure 8B:
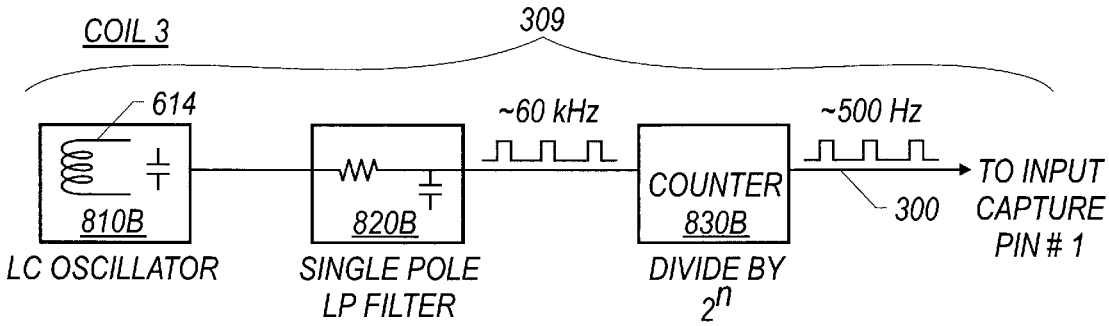

FIGS. 8A and 8B show more details of the electrical configuration of oscillators 303 and 309. Oscillator circuitry 303 includes an LC oscillator circuit 810A, which includes coil 612 as part of the tank circuit thereof. A low-pass filter 820A, which in this embodiment is a simple single-pole filter, is driven by the oscillator to provide a simple output at a frequency in the neighborhood of 150 kHz. (However, this frequency will be pulled when a coin is present in the chute to thereby change the inductive loading seen at coil 612.) The counter 830A divides down the incoming wave train, and provides an output on line 300, at a frequency of about 500 Hz, to the microprocessor. Similarly, as shown in FIG. 8B, oscillator circuitry 309 includes an LC oscillator 810B which is coupled to coil 614, a filter 820B, and a counter 830B with an output on line 308.

Software Overview

The innovative operations will now be further reviewed, and details of the preferred software implementaion will be explained.

Overview of Operation

When coin 106 is dropped into chute 312, three parameters of coin 106 are measured. The first two, c1 and c3, are described as content (metallic) measurements, and the third is the diameter of the coin. The following definitions apply:

- c1 is the difference in frequency of coil 612 when the coin is in coil 612 versus when the coin is not in coil 612;
- c3 is the difference in frequency of coil 614 when the coin is in coil 614 versus when the coin is not in coil 614; and
- diameter is a value calculated using pulses generated by the size detector circuit as a result of coin edges passing through rows 700 and 701 of the emitter/detector arrays.

The pulse edges from the diameter circuit are used to gate the sampling of the two coils.

As coin 106 interrupts any emitter/detector of row 700, a portion of the coin will be in the coil 612 field, but not the coil 614 field. Coil 612 and coil 614 frequencies are then measured and stored. Next, as the trailing edge of the coin leaves the bottom array and passes through coil 614, coil 612 and coil 614 frequencies are again measured and stored. The content parameter is then calculated by the absolute value of the difference of the previous value and the current value. This technique produces a diameter-related content measurement because a larger coin will have more of its mass within the coils at sampling time than a smaller coin.

Determination as to whether a coin is accepted or rejected is based upon a comparison between the measured parameters c1, c3, and diameter, and the stored averages obtained during training.

Sequence of Events

FIG. 1A shows the sequence of events as a coin falls down the chute 312. The handling of these events by the hardware described above, and by the innovative operating methods described herein, will now be described.

More specifically, coin 106 falls freely down chute 312 to top coil 612, as depicted in FIG. 1A1. Before coin 106 interrupts any of row 700 emitter/detectors, the DIADATA register is all zeros.

As coin 106 passes through coil 612, and as depicted in FIG. 1A2, it interrupts one of the emitter/detectors on row 700. As a result, ISR #2 (interrupt service routine #2) shifts a 1 bit into the DIADATA register as shown. ISRs #1 and #3 sense the bit change in the DIADATA register and take action to sample and store pulse widths from oscillators 303 and 309.

Figure 10:
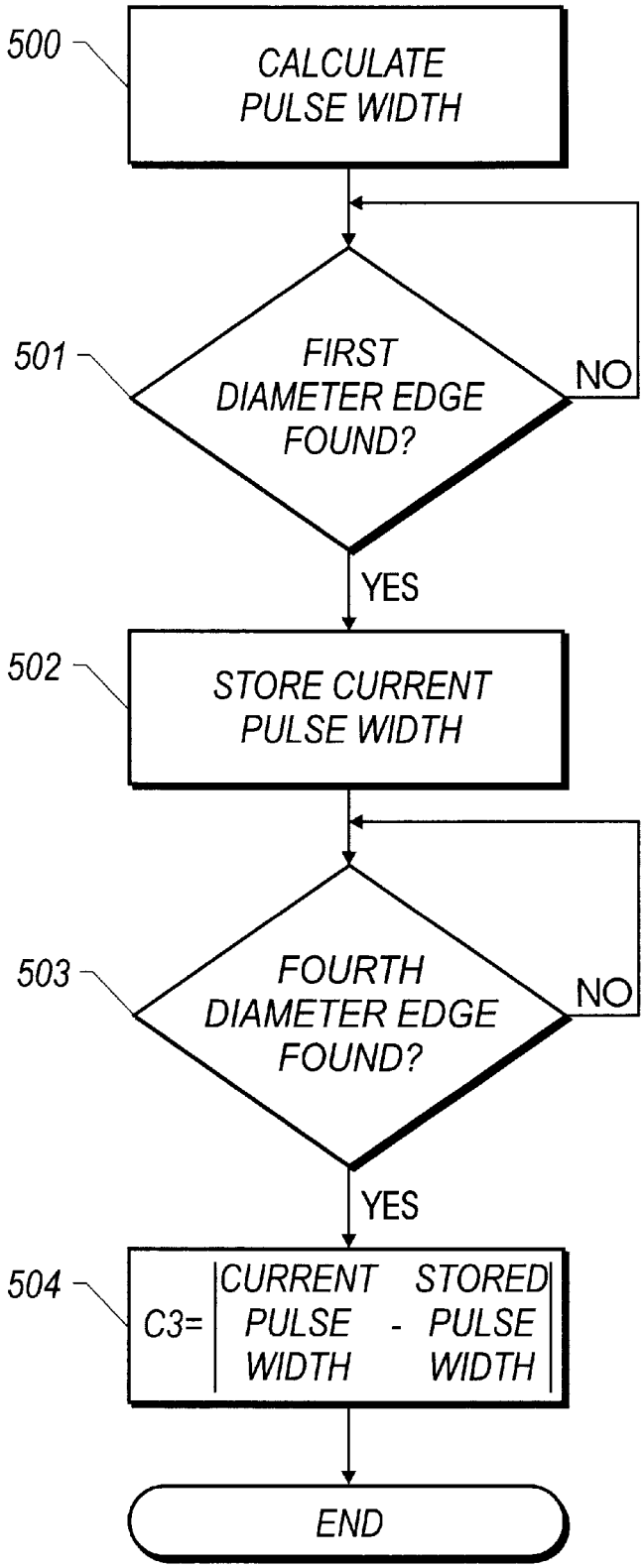
FIG. 10 shows a software flowchart for coil 3 input capture interrupt service routine.

As shown in FIG. 10, ISR #1 executes comparison 501 after pulsewidth calculation 500. Since this is the first edge detected, statement 502 executes and stores the width value of the pulse generated by oscillator circuit 309.

Figure 12:
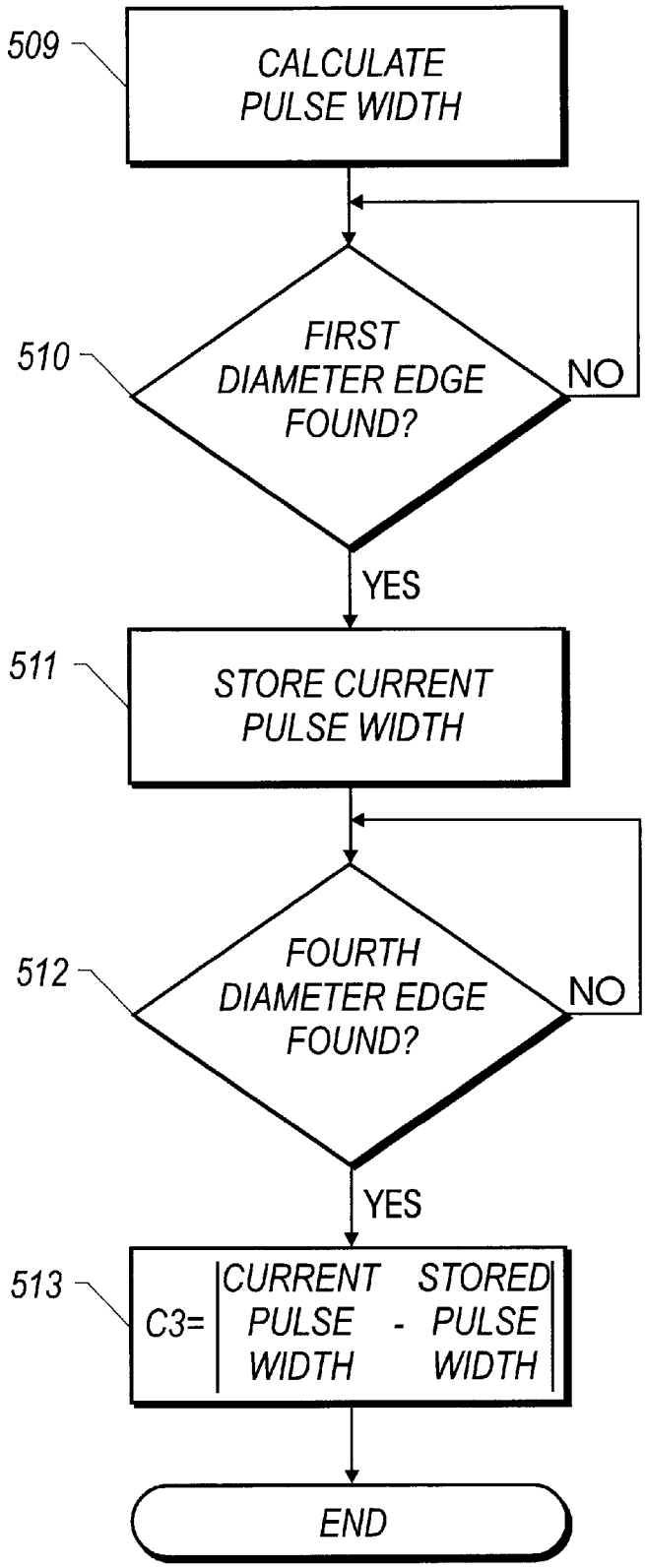
FIG. 12 shows a software flowchart for coil 1 input capture interrupt service routine.

As shown in FIG. 12, ISR #3 executes comparison 510. Again, since this is the first edge detected, statement 511 executes and stores the width value of the pulse generated from the oscillator circuit 303.

As depicted in FIG. 1A3, coin 106 continues down chute 312 and interrupts the link between emitter/detectors in second row 701. ISR #2 now shifts another 1 bit into the DIADATA register. ISR #1 and ISR #3 do not take action at this time.

As coin 106 continues down chute 312, its trailing edge exits row 700, as depicted in FIG. 1A4. ISR #2 now shifts another 1 bit into the DIADATA register. ISR #1 and ISR #3 do not take any action at this time.

As coin 106 continues down chute 312 its trailing edge exits from emitter/detector row 701, as depicted in FIG. 1A5. At this point in time, the body of coin 106 is in the field of coil 614. ISR #2 now shifts another 1 bit into the DIADATA register.

Both ISR #1 and ISR #3 take action from detection of the fourth edge. As shown in FIG. 10, ISR #1 executes comparison 503, and captures the width value of the pulse generated by coil oscillator 309. Statement 504 determeines, and stores in c3, the absolute value of the difference between the first stored pulse width and the current pulse width.

ISR #3 executes comparison 512 and captures the width value of the pulse generated from the oscillator circuit 303. Statement 513 determines, and stores in c1, the absolute value of the difference between the first stored pulse width and the current pulse width.

Figure 11:
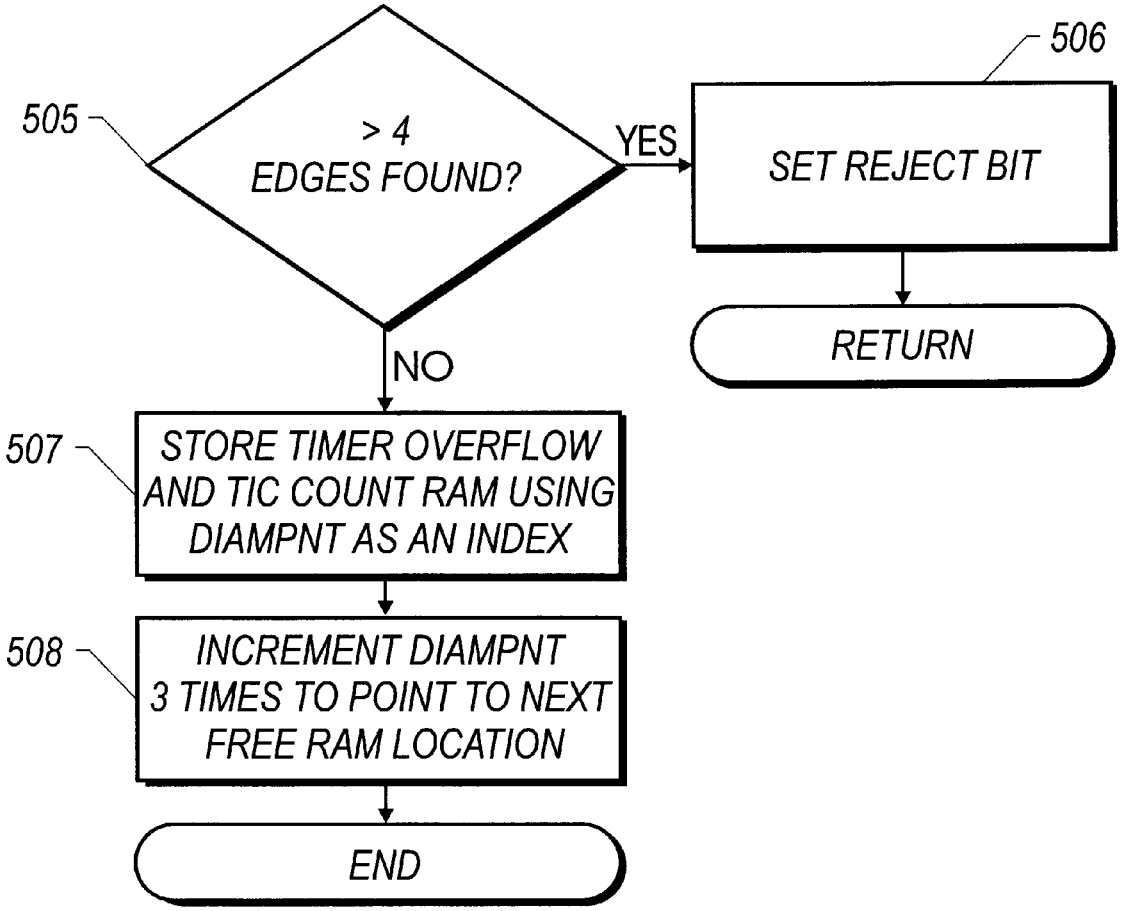
FIG. 11 shows a software flowchart for a diameter detector input capture interrupt service routine.

Finally, coin 106 passes coil 614, as depicted in FIG. 1A6. FIG. 11 shows an important function of ISR #2: if more than four edges are detected, comparison 505 directs the execution of statement 506, and thereby rejects the coin; otherwise comparison 505 directs the execution of steps 507 and 508.

Input Capture ISR #3 (coil 1—top coil)

The function of this routine is to store the width value of a pulse created as a result of the leading edge of coin 106 interrupting the row 700 emitter/detector array and the trailing edge of coin 106 leaving the row 701 emitter/detector array. Major steps in this routine are shown in FIG. 12.

ISR #1 and ISR #3 are activated by edges from the counter chip for each oscillator circuit. The ISRs subtract the current tic count from the previous count (stored in FRSTE1 and FRSTE3) to calculate the pulse width (or coil frequency). Additionally, the ISRs check DIADATA to see if any other action needs to be taken. If DIADATA=00000001 (FIG. 1A2, first diameter edge) the current pulse width is stored in memory (MIN1 or MIN3). If DIADATA=00001111 (FIG. 1A5, 4th diameter edge) then the current pulse width is subtracted from the stored value (MIN1 or MIN3) to find the coil content.

The pertinent source code follows:

```
IF OPTDIA=1
TIC3IRQ:
    LDX     #CDCSTBL
    BRSET   CDCSFLG, X, #CDST3, TIC3I50        * FIRST EDGE FOUND ?
    BSET    CDCSFLG, X, #CDST3                 * NO, SET FIRST EDGE FLAG
    LDD     TIC3                               * SAVE FIRST EDGE
    STD     FRSTE3
    BRA     TIC3I90                            * END ISR
TIC3I50:
    LDD     TIC3
    SUBD    FRSTE3                     * CALCULATE PULSE WIDTH
    BRSET   CDDATA, X, #C1FRST, TIC3DIA1
    BRCLR   DIADATA, X, #DIASTART, TIC3I70
    STD     MIN1
    BSET    CDDATA, X, #C1FRST
    BRA     TIC3I70
TIC3DIA1:
    BRSET   CDDATA, X, #C1LST, TIC3I70
    BRCLR   DIADATA, X, #DIADONE, TIC3I70
    SUBD    MIN1
    %ABSD
    STAB    C1, X
    BSET    CDDATA, X, #C1LST
TIC3I70:
    LDD     TIC3                       * SAVE EDGE
    STD     FRSTE3
TIC3I90:
    LDAA    #IC3F
    STAA    TFLG1
    RTI
    ENDIF
```

Input Capture ISR #1 (coil 3—bottom coil)

The function of this routine is to determine the width of a pulse created as a result of the leading edge of the inserted coin breaking the top emitter/detector array and the trailing edge leaving the bottom emitter/detector array. If the leading edge is found, the current pulse width is stored. Next, if the trailing edge is detected, c3 is calculated as the absolute value of the difference of the current pulse width and the stored pulse width.

ISR #1 and ISR #3 are activated by edges from the counter chip for each oscillator circuit. The ISRs subtract the current tic count from the previous count (stored in FRSTE1 and FRSTE3) to calculate the pulse width (or coil frequency). Additionally, the ISRs check DIADATA to see if any other action needs to be taken. If DIADATA=00000001 (FIG. 1A2, first diameter edge) the current pulse width is stored in memory (MIN1 or MIN3). If DIADATA=00001111 (FIG. 1A5, 4th diameter edge) then the current pulse width is subtracted from the stored value (MIN1 or MIN3) to find the coil content.

The pertinent source code is as follows:

```
IF OPTDIA=1
TIC1IRQ:
    LDX     #CDCSTBL
    BRSET   CDCSFLG, X, #CDST1, TIC1I50        * FIRST EDGE FOUND ?
    BSET    CDCSFLG, X, #CDST1                 * NO, SET FIRST EDGE FLAG
    LDD     TIC1                               * SAVE FIRST EDGE
    STD     FRSTE1
    BRA     TIC1I90                            * END ISR
TIC1I50:
    LDD     TIC1
    SUBD    FRSTE1                     * CALCULATE PULSE WIDTH
    CPD     MAX3                       * SAVES MIN/MAX FOR JAM DETECTION
    BLS     TIC1DIAJA
    STD     MAX3
```

-continued

```
TIC1DIAJA:
    CPD     MIN3
    BHS     TIC1DIAJB
    STD     MIN3
TIC1DIAJB:
    BRSET   CDDATA, X, #C3FRST, TIC1DIA1      * FIRST SAMPLE ?
    BRCLR   DIADATA, X, #DIASTART, TIC1I70
                                        * NO, CHECK FOR FIRST DIAMETER EDGE
    STD     MIN2
                                    * SAVE COIL VALUE ON FIRST DIAMETER EDGE
    BSET    CDDATA, X, #C3FRST
    BRA     TIC1I70
TIC1DIA1:
    BRSET   CDDATA, X, #C3LST, TIC1I70        * SECOND SAMPLE ?
    BRCLR   DIADATA, X, #DIADONE, TIC1I70
                                        * NO, CHECK FOR LAST DIAMETER EDGE
    SUBD    MIN2
              * SUBTRACT CURRENT COIL VALUE FROM VALUE STORED ON 1ST EDGE
    %ABSD                                   * ABSOLUTE VALUE
    STAB    C3, X                           * STORE CONTENT VALUE
    BSET    CDDATA, X, #C3LST               * SET DONE BIT
TIC1I70:
    LDD     TIC1                        * SAVE EDGE
    STD     FRSTE1
TIC1I90:
    LDAA    #IC1F                   *RESET INPUT CAPTURE INTERRUPT FLAG
    STAA    TFLG1
    RTI
    ENDIF
```

Input Capture ISR #2 (diameter detector)

ISR #2 is for the diameter detection. It performs three different, but related operations. First it stores the time (TIMEROVERFLOW and TIC count) for the four diameter edges. Second, it shifts a 1 into DIADATA on each diameter edge to signal ISR #1 and ISR #3 to take action on the data from the coil oscillators. Finally, because a 1 is shifted into DIADATA on each diameter edge, shifting a 5th bit causes the DIAREJECT bit to set, thus rejecting the coin.

The pertinent code follows:

```
#define dia_firstedge ( diadata & 0×01 )
#define dia_lastedge ( diadata & 0×08 )
#define dia_reject ( diadata & 0×10 )
IF OPTDIA=1
***************************
*   OPTICAL DIAMETER DETECTION
***************************
TIC2IRQ:
    LDX     #CDCSTBL
    LDAB    DIADATA, X              * DIADATA COUNTS THE NUMBER OF DIAMETER EDGES
    LSLB
    ORAB    #01H                            * NEW EDGE, SHIFT 1 INTO DIADATA
    STAB    DIADATA, X
    BRSET   DIADATA, X, #DIAREJECT, TIC2I100        * CHECK REJECT BIT ( 5TH EDGE )
    LDY     DIAMPNT                     * LOAD DATA POINTER
    LDAB    TIMEROVERFLOW, X                * SAVE TIMEROVERFLOW VALUE
    STAB    0, Y
    LDD     TIC2                            * LOAD TIC COUNT
    BMI     TIC2OV1
    TST     TFLG2
    BPL     TIC2OV1
    INC     0, Y                    * IF tof = 1 AND MSB OF TIC2 = 0, INCREMENT tof
TIC2OV1:
    INY
    STD     0, Y                            * SAVE TIC COUNT
    INY
    INY
    STY     DIAMPNT                     * SAVE DATA POINTER
TIC2I100:
    LDAA    #IC2F                       * RESET INPUT CAPTURE INTERRUPT FLAG
    STAA    TFLG1
    RTI
    ENDIF
```

Discriminator Program

The discriminator routine performs three operations upon measured parameters of the inserted coin. First, it compares measured diameter value of the inserted coin with stored diameter margins. Second, it compares measured metallic content values with stored content averages and determines the total number of content margins in which the inserted coin could fit. Finally, it calculates the distances from each of the content average points to the inserted-coin value and selects the minimum. The minimum distance is compared to the maximum allowable margin from the selected content grouping to ensure that the data point is valid.

Figure 13A:
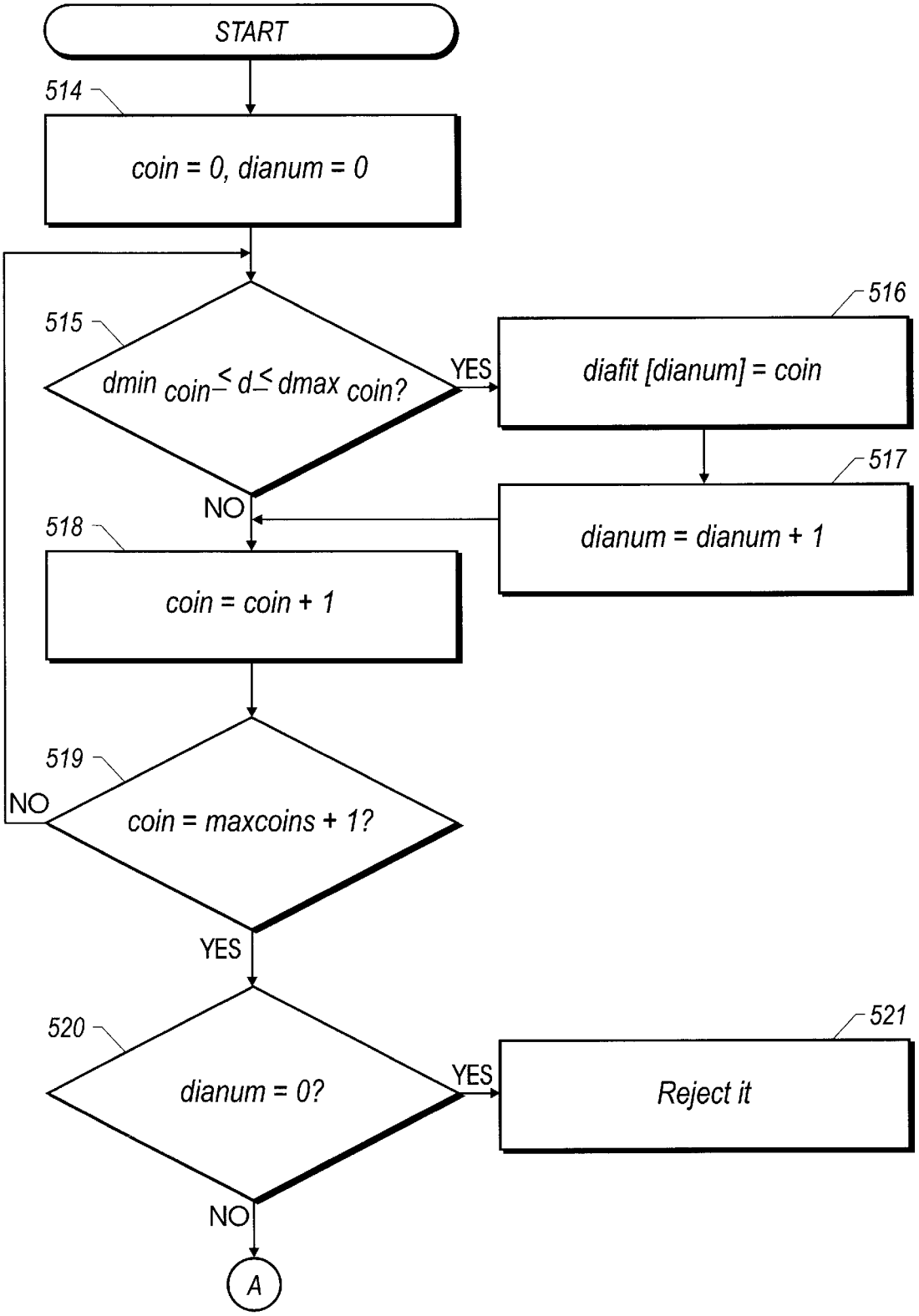
FIGS. 13A and 13B show a software flowchart for a discriminator routine.
Figure 13B:
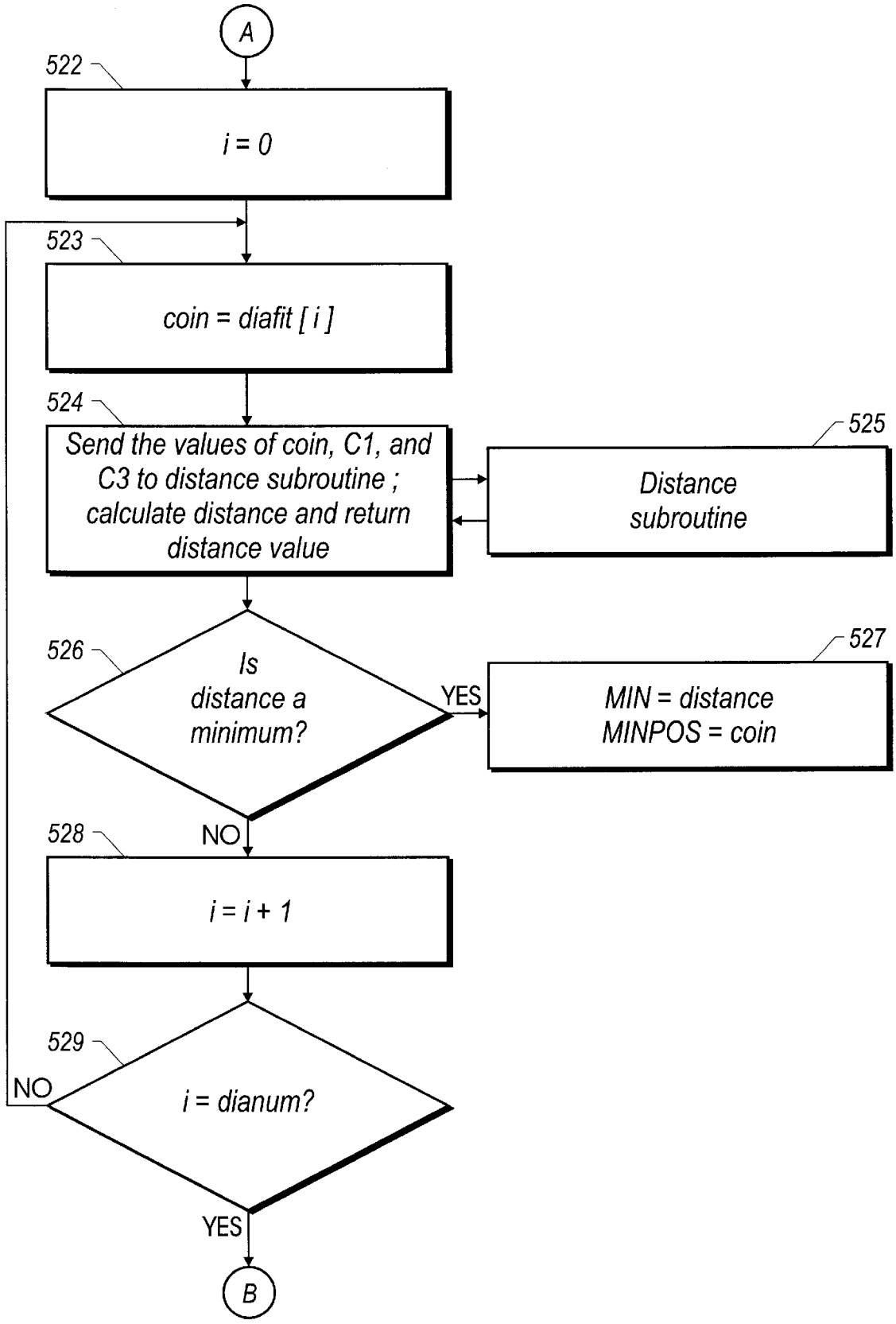
Figure 13C:
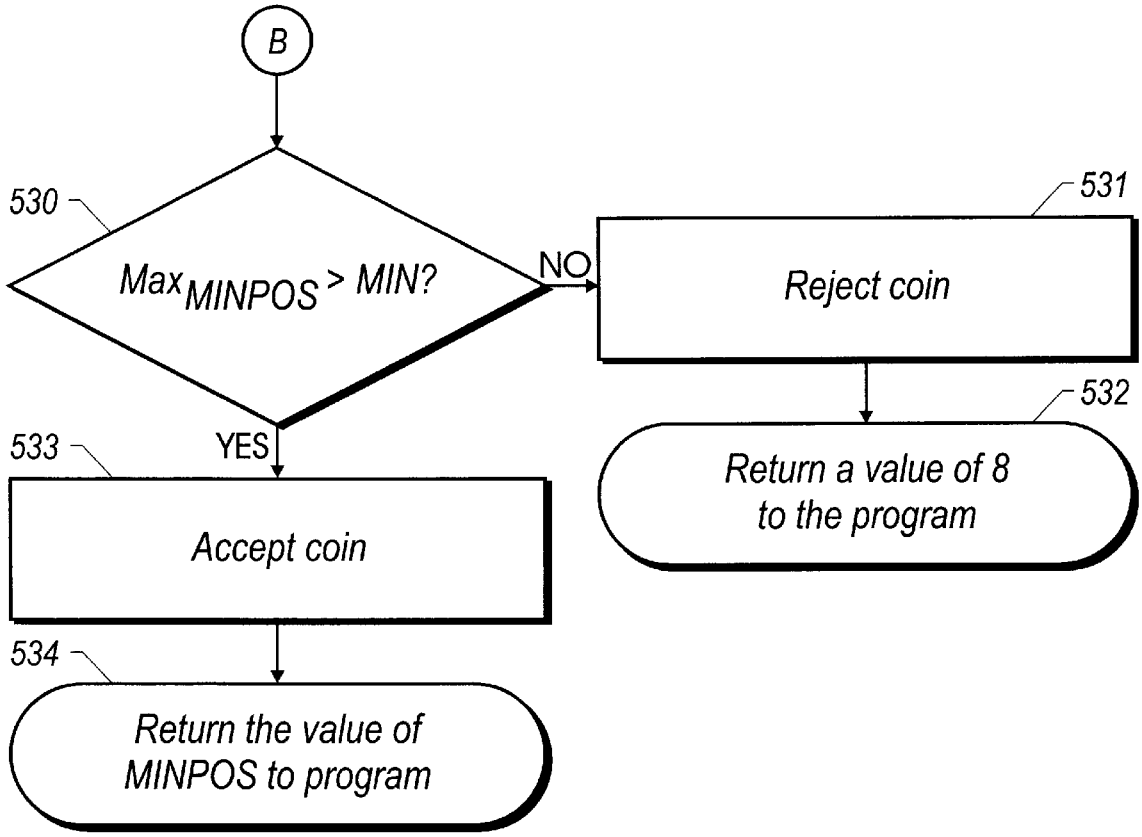

In the initial condition 514, the coin number is 0 and dianum is 0. First, comparison 515 (FIG. 13A) is made between the measured diameter of the inserted coin 106 and stored allowable margin values obtained through training. If the measured diameter is within a range of margins for the first coin of that coin set, the coin number is passed into statement 516 and an array called diafit. In statement 517, array pointer dianum is incremented by one position, in preparation for the next comparison. On the other hand, if comparison 515 fails, a comparison is made (step 518 and comparison 519) against the next set of allowable margins of the coin set. The measured diameter is again compared to the allowable margins in comparison 515. The process continues until the measured diameter is compared against all allowable margins of the particular coins in that coin set. If the measured diameter did not fall within any allowable margins, that is, comparison 520 of dianum reveals that coin 106 was not within any allowable diameter margins, the coin is rejected at statement 521. If the measured diameter falls into at least one allowable margin, program flow continues to the next level (FIG. 13B).

Figure 14:
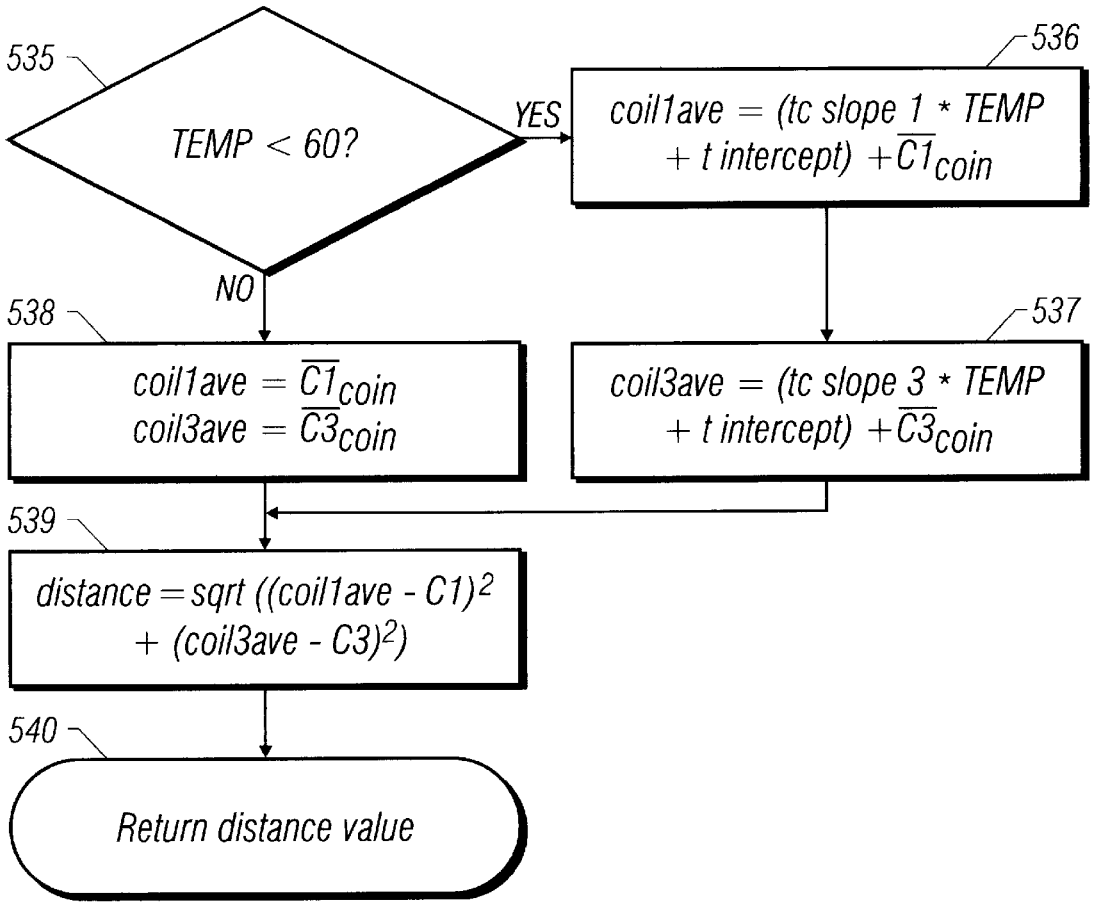
FIG. 14 shows a software flowchart for a distance calculation.

The next level performs calculations not only on the measured diameter values stored in the array in level one of the routine, but also on measured content values c1 and c3. After initializations 522 and 523, statement 524 sends the first array value of the measured diameter along with c1 and c3, and the measured content values, to distance subroutine 525 (shown in detail in FIG. 14, and discussed below).

When the distance value is returned, comparison 526 is made to determine if it is a minimum distance. In some cases, coin characteristics can overlap, indicating two or more possible fits for a particular coin. Determining the minimum distance to stored averages resolves this problem (step 527). Iteration is provided by steps 528 and 529.

As a final test (comparison 530), if the shortest distance (nearest coin) MIN is less than the maximum distance for that coin type ($MAX_{MINPOS}$), then the coin is accepted (step 533) and the nearest coin number MINPOS is passed to the rest of the program (sep 534). Otherwise, the coin is rejected (steps 531 and 532)

Pertinent code follows:

```
#define MAXDIST CCDTBL[minpos * 9 + 6]
extern void enable__coin__interrupts ( void );
extern void disable__coin__interrupts ( void );
extern void enable__coinchute ( void );
extern void disable__coinchute ( void );
unsigned char discrim ( void )
{
    extern unsigned char c1min1, c1minh; c1max1, c1maxh;
    extern unsigned char c3min1, c3minh, c3max1, a3maxh;
    extern unsigned char CCDTBL[93];                /* coin chute eeprom table */
    extern unsigned char binbuf[4];                         /* 4 char LCD buffer */
    extern unsigned char timeroverflow, diadata, cmdflq1, cmdflg3, c1, c3;
    unsigned char distance[4] = {255, 255, 255, 255}, minpos, mindist=255, coin;
    unsigned char diameter, i, index, j = 0, tcnt;
    unsigned char diafit[5];
    load__diapntr( );
    c1min1 = c1minh = c3min1 = c3minh = 255;
    c1max1 = c1maxh = c3max1 = c3maxh = 0;
    timeroverflow = 0;
    enable__coin interrupts( );
    while( timeroverflow < 8 && !dia__firstedge );     /* wait for first edge */
    if( !dia__firstedge )                                          /* timeout */
    {
        disable__coin__interrupts( );
        disable__coinchute( );
        return( 8 );
        }
    while ( !dia__lastedge && timeroverflow < 12 );
                                                /* wait for dia detector done */
    if ( timeroverflow >= 12 )                                     /* timeout */
    {
        disable__coin__interrupts( );
        disable__coinchute( );
        return( 8 );                    /* timeoutexceeded for last dia edge */
        }
```

-continued

```
tcnt = timeroverflow;
while ( timeroverflow - tcnt < 2 ) ;          /* wait ~2 more timeroverflows */
if ( dia_reject )                    /* reject if 5th bit of diadata is set */
{                                                          /* extra edge */
    disable_coin_interrupts( );
    disable_coinchute( );
    return ( 8 );
    }
measure_temp( );
disable_coin_interrupts( );
disable_coinchute ( );
diameter = calcdia( );
```

This discrimination routine checks content for any coin that first fits into a diameter margin. It allows for the coin to fit into more than 1 diameter margin (in case of overlapping diameters) and will pick the coin with the closest content distance. Two content discrimination factors, c1 and c3, are used. C is the absolute value of differences in coil frequency when measured at the first and fourth edge of the diameter detector. Distances are computed for the coin slots with fitting diameter margins. If the smallest distance (nearest coin) is less than the MAXDIST for that coin slot, then the coin is accepted and the nearest coin number is passed to the rest of the program.

4 bytes are needed in CCDTBL (eeprom) for each coin.

0—c1 mean

1—c3 mean

2—diameter mean

3—maximum content distance (MAXDIST)

Diameter margins are a fixed +/− amount from the diameter mean.

This quantity, called DIAMARG, is set in CCDTBL.

```
for( i = 0 ; i < CCDTBL[0] ; i++ )
{
        index = i * 9 + 8 ;                          /* point to diameter mean
        if( ( diameter >= CCDTBL[index] ) && ( diameter <= CCDTBL[index+2] ))
            diafit[j++] = i;   /* save coin number if diameter within margins */
            }
if( j == 0 ) return( 8 /* doesn't fit in any diameter margins, reject */
for( i = 0; i < j; i++/* j == # of coin slots that coin dia fits into */
{
        distance [i] = calcdist ( diafit [i], c1 , c3 );
        if( distance[i] < mindist )
        {
            mindist = distance[i]; /* save closest distance + nearest coin num */
            minpos = diafit [i];
            }
            }
if( mindist <= CCDTBL[ minpos * 9 + 6 ] ) coin = minpos;          /* accept coin */
else coin = 8;                                                    /* reject coin */
```

Distance Calculation Subroutine

The distance subroutine (FIG. 14) determines the straight line distance values between the measured coin value and any coin content averages stored in EEPROM. This routine also accounts for any low temperature effects that may occur. The two distances values are then returned to the main program where a comparison is made to determine which is the minimum distance to the measured value of the inserted coin.

The TEMP variable is an 8-bit value that corresponds to minus 40 degrees C. at 0 bits and 85 degrees C. at 255 bits. In comparison 535 (FIG. 14), if TEMP is less than 60 bits, the temperature compensation equation 536 executes to calculate the coillave value. Similarly, temperature compensation equation 537 executes to calculate coil3ave value. The results of statements 536 and 537 are then used in the execution of statement 539 to determine the temperature compensated value for distance. If TEMP is greater than or equal to 60 bits, statement 538 is executed and the value for distance is calculated without compensating for temperature. Once step 539 is completed, a distance value is returned in step 540.

Temperature compensation is computed by first finding the average response for each coil (per coin) at room temperature and then subtracting this average from the coil response for temperatures less than room temperature. A linear least-squares regression is computed for each coil. The coefficients are used in the arrays tcompint (y-intercept) and tcompslope (slope). The slope and intercept are used to compute the shifting of coin averages with temperature.

The pertinent source code follows:

```
#define C1AVE CCDTBL[index]
#define C3AVE CCDTBL[index+2]
unsigned char calcdist( unsigned char coin, unsigned char cl,
unsigned char
c2
{
    unsigned char index, con1, con3;
    extern unsigned char CCDTBL[93];
    int temp1, temp2;
```

-continued

```
    index = coin * 9 + 2;
    if( ADR1 < 60 )                    /* temp comp if temp <~ 10C. */
                                         /* ADR1 = 0, temp = -40C. */
                                       /* ADR1 = 255, temp = +85C. */
    {
        temp1 = (int) ( tcompslope1[coin] * (float)ADR1 +
        tcompint1[coin] ) +
        (int)CCDTBL[index];
        temp2 = (int) ( tcompslope3[coin] * (float)ADR1 +
        tcompint3[coin] ) +
        (int)CCDTBL [index+2];
        }
    else
    {
        temp1 = (int)CCDTBL[index];
        temp2 = (int)CCDTBL[index+2];
    }
if( temp1 < 0 )
        con1 = 0;
else
        con1 = (unsigned char)temp1;
if( temp2 < 0; )
        con3 = 0;
else
        con3 = (unsigned char)temp2;
return( (unsigned char) ( sqrt( (float) ( sqr( con1 - c1 )) + (float) ( sqr(
con3 - c2 )))));
}
```

Diameter Calculation

Figure 9:
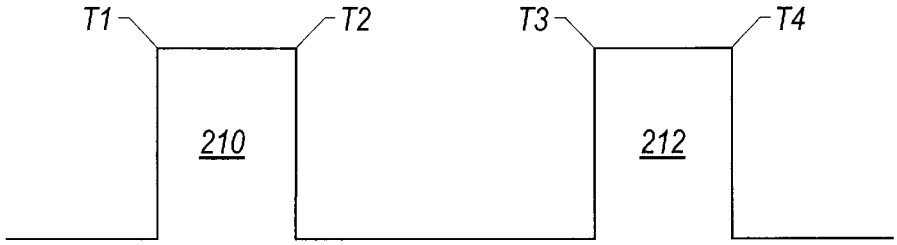
FIG. 9 shows a timing diagram generated by the detector and calculations for distance parameter.

Input capture ISR#2 (as shown in FIG. 9) saves the time of the four diameter edges as 24-bit numbers (8 bits for timeroverflow+16 bits for timer count).

The calculation used is:

$$\text{diameter} = \frac{T4 - T1}{T2 - T1} + \frac{T4 - T1}{T4 - T3}$$

The pertinent code follows:

```
unsigned char calcdia( void )
{
    extern unsigned char t1ov1, t2ov1, t3ov1, t4ov1, t1high, t2high,
            t3high, t4high, t1low, t2low, t3low, t4low;
    unsigned long t1, t2, t3, t4;
    float diameter;
    t1 = (unsigned long )t1ov1 *65536L + (unsigned long )t1high * 256
        + (unsigned long )t1low;
    t2 = (unsigned long )t2ov1 * 65536L + (unsigned long )t2high * 256
        + (unsigned long )t2low;
    t3 = (unsigned long )t3ov1 * 65536L + (unsigned long )t3high * 256
        + (unsigned long )t3low;
    t4 = (unsigned long )t4ov1 * 65536L + (unsigned long )t4high * 256
        + (unsigned long )t4low;
    diameter = 10 * ( (float) ( t4 - t1 ) / (float) ( t2 - t1 ) + (float) ( t4 -
        t1 ) / (float) ( t4 - t3 ) );
    if( modf( diameter, NULL ) > 0.5 ) diameter++;
    return( (unsigned char)diameter ) ;
    }
```

Training

Figure 7:
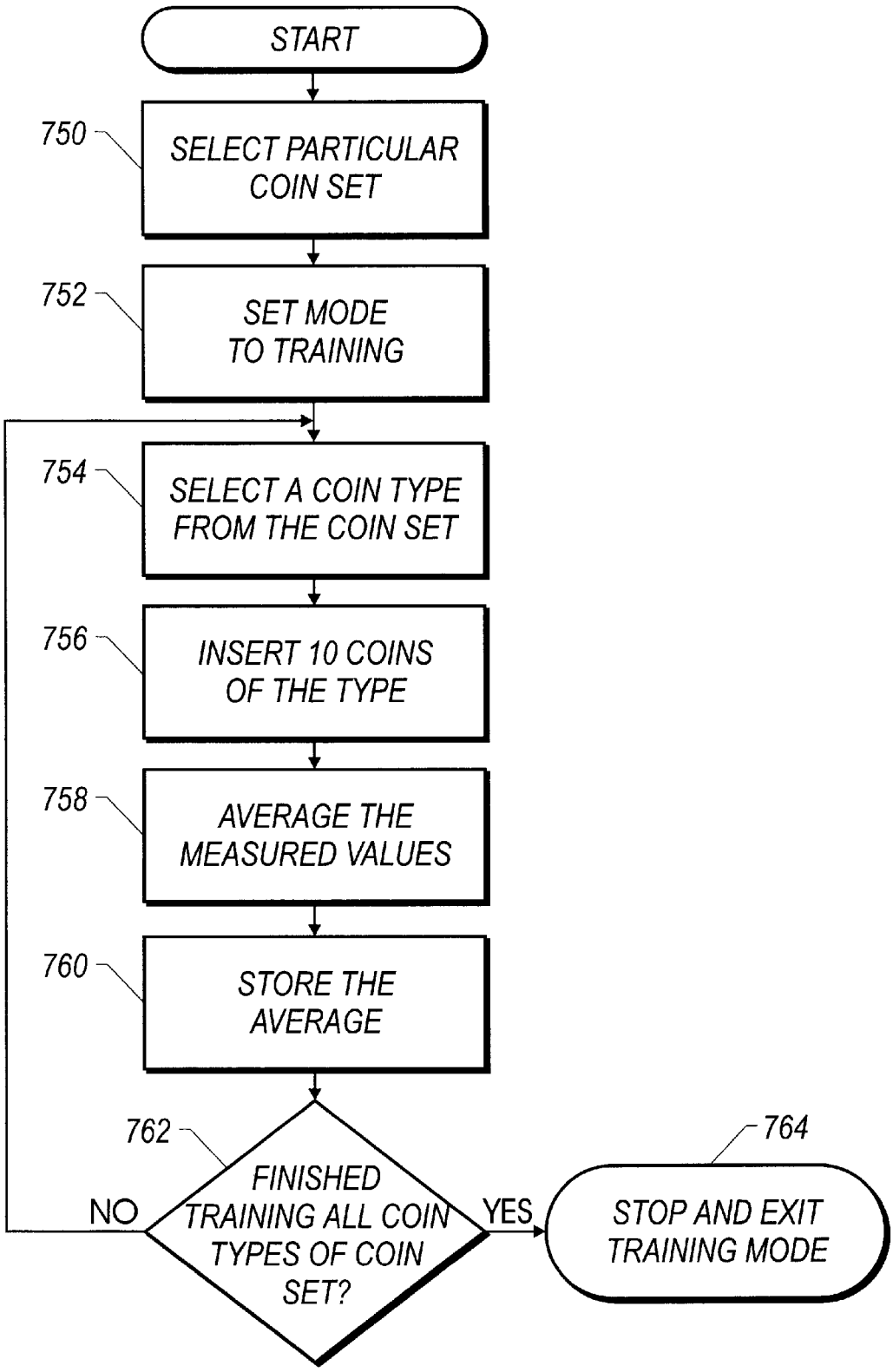
FIG. 7 shows a software flowchart of the training method.

Training (FIG. 7) is a calibration process where the user is instructed to insert ten coins of each particular type of coin in a coin set. In statement 750, the user selects a particular coin set. Next, the user selects training mode as in statement 752. In statement 754, the user then selects a particular coin denomination and inserts ten coins of that denomination, as requested in statement 756. Upon receipt of ten coins, statement 758 of the algorithm separately averages the values of the c1 content, c3 content, minimum diameter, maximum diameter, and uses a pre-stored maximum distance parameter for each of the ten coins. Statement 760 stores these average values in EEPROM. This process is repeated for each type of coin in the coin set. Comparison 762 determines when all coins of a coin set have been inserted and directs program flow to statement 764, where training stops. The EEPROM stores values for one coin set.

The following parameters are defined for the software flowchart:

$c1_x$ - average content for coil 1, $coin_x$ (x=0 to # of coins in coin set)
$c3_x$ - averaqe content for coil 3
$dmax_x$ - maximum allowable diameter for $coin_x$
$dmin_x$ - minimum allowable diameter for $coin_x$
$max_x$ - maximum allowable distance for $coin_x$
($c1_x$, $c3_x$, $dmax_x$, $dmin_x$, and $max_x$ are stored in EEPROM)
c1 - coil 1 content for inserted coin
c3 - coil 3 content for inserted coin
d - measured diameter
maxcoins - # of valid coins in the coin set
dianum - # of diameter margins into which the coin fits

Alternative Embodiment—Integrated Discriminator Module

Figure 15:
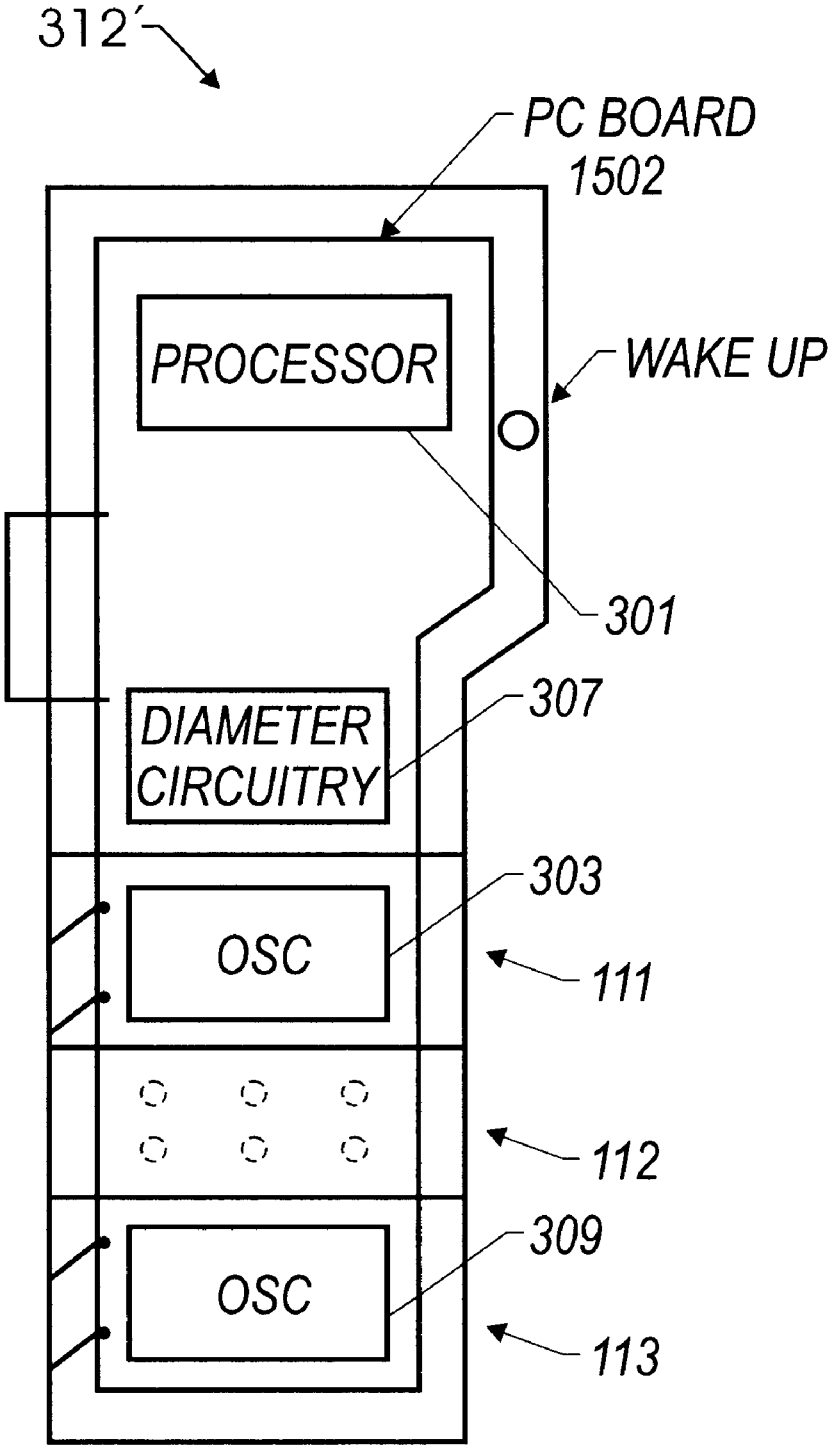
FIG. 15 shows an integrated processor-coin chute assembly.

FIG. 15 shows an alternative embodiment, in which key portions of the electronics are mounted on the coin chute's sidewall. Specifically, a PC board 1502, which is supported by the side of the coin chute 312' supports the processor 301 and the optical detector circuitry 307, as well as both oscillators 303 and 309. This permits the RF elements to be closely coupled to the zones 111 and 113 in which loading by the coin is tested. This also provides a very compact "smart coin chute" assembly which can be readily integrated with a variety of systems.

Sample Vending Machine Configuration

Figure 16:
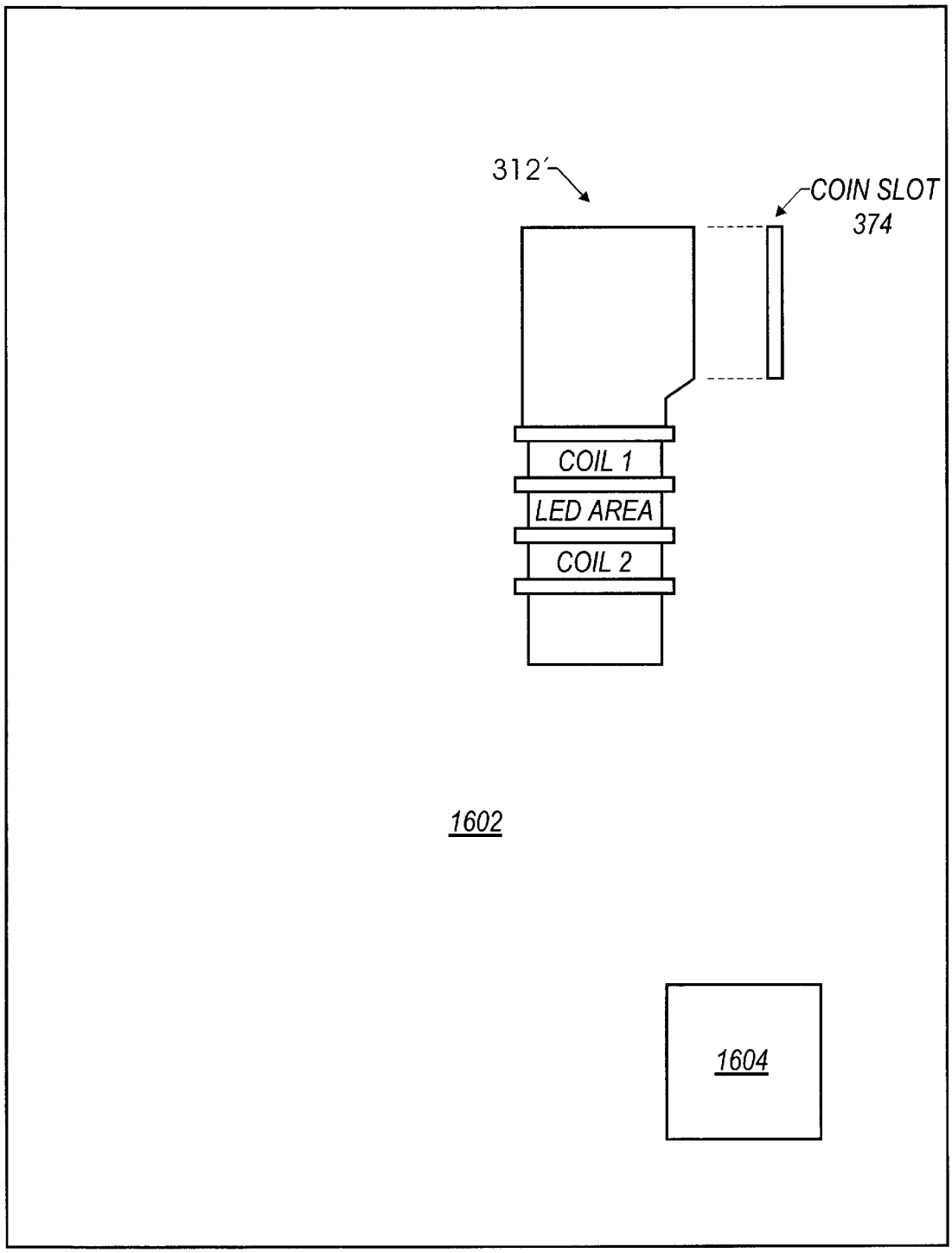
FIG. 16 shows an application of the preferred embodiment to a vending machine.

FIG. 16 shows a sample vending machine system, in which a "smart coin chute" 312' according to FIG. 15 is used to detect coins inserted into a coin slot 374. The vending machine 1602 includes electromechanical motors and/or relays, controlled by the microprocessor on the smart coin chute 312', which controls dispensing of product (such as soda cans or candy) into product output slot 1604.

Alternative Embodiment—Single Coil

It should also be noted that the disclosed innovative ideas are not limited to double-coil implementations, but may also operate with a single coil. The enhanced timing of oscillator sampling which is provided by the disclosed inventions is particularly advantageous in this context.

Figure 6B:
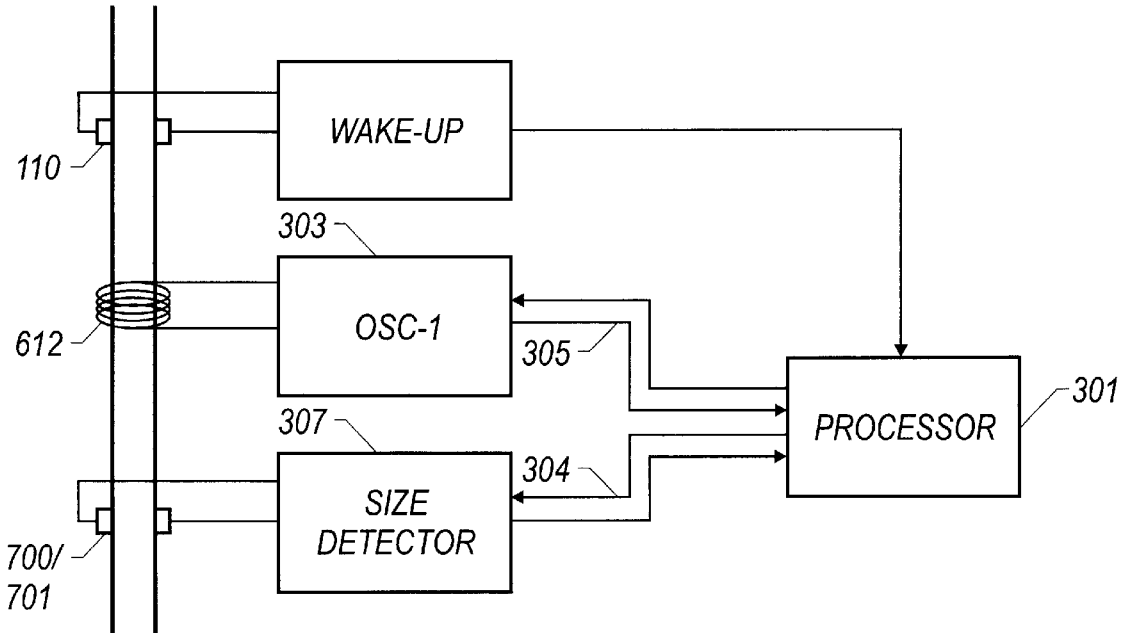
FIG. 6B shows a flow chart with a variation on the embodiment of the coin discriminating method using a single coil.

FIG. 6B shows an alternative embodiment, in which only one loading coil 612 and one oscillator 303 is used. This system is otherwise similar to the system of the presently preferred embodiment. Good coin recognition performance has already been demonstrated with this embodiment.

Alternative Embodiment—Single Row of LEDS

It should also be noted that the disclosed innovative ideas are not limited to two rows of emitter/detectors pairs, but may also operate with a single row of emitter/detector pairs where triggering for the measurement of coin content is by both edges of the inserted coin.

According to a disclosed class of innovative embodiments, there is provided: A coin discriminator system, comprising: optical detector elements positioned to ascertain the position of a coin in a coin chute; a programmed logic element, connected to receive at least one position indicator output from said optical detector elements, and to access a memory which includes coin recognition data; and an oscillator circuit which is electromagnetically coupled to the interior of said coin chute; wherein said programmed logic element is programmed to sample a frequency measurement from said oscillator circuit when said position indicator output is received, and to look up coin identification data in said memory, using said frequency measurement as input, and to output coin identification data in dependence on data read from said memory.

According to another disclosed class of innovative embodiments, there is provided: A parking meter system, comprising: optical detector elements positioned to ascertain the position of a coin in a coin chute; a programmed logic element, connected to receive at least one position indicator output from said optical detector elements, and to access a memory which includes coin recognition data and a timer which provides timing data to said programmed logic element; an oscillator circuit which is electromagnetically coupled to the interior of said coin chute; and a display, connected to be controlled by said programmed logic element, which controllably indicates expired and unexpired status; wherein said programmed logic element is connected to compute available time in dependence on said timing data and said coin recognition data, and to change said display between indication of expired and unexpired status accordingly.

According to another disclosed class of innovative embodiments, there is provided: A vending machine system, comprising: a programmed logic element, connected to access a memory which includes coin recognition data; a coin chute into which users can insert coins; and a product dispensing mechanism, connected to be controlled by said programmed logic element; wherein said programmed logic element is connected to control said product dispensing mechanism in at least partial dependence on said coin recognition data.

According to another disclosed class of innovative embodiments, there is provided: A method for coin discrimination, comprising the steps of: a) recognizing the presence of a coin in a coin chute; b) after said step a), recognizing, using one or more optical detector elements, the position of said coin in said coin chute; c) at a time determined by said position-recognizing step b), sampling a frequency measurement from a first oscillator circuit which is electromagnetically coupled to the interior of said coin chute; and d) using recognition parameters from one or more iterations of said steps b) and c), looking up said recognition parameters in a table that contains data on recognizable coin types; and e) outputting coin identification data in dependence on the result of said step d).

According to another disclosed class of innovative embodiments, there is provided: A method for coin discrimination, comprising the steps of: a) recognizing, using one or more optical detector elements, the position of a coin in a free-fall coin chute; b) at a time determined by said recognizing step a), sampling an isolated frequency measurement from a first oscillator circuit which is electromagnetically coupled to the interior of said coin chute; and c) using recognition parameters from one or more iterations of said steps a) and b), looking up said recognition parameters in a table that contains data on recognizable coin types; and d) outputting coin identification data in dependence on the result of said step c).

Modifications and Variations

As will be recognized by those skilled in the art, the innovative concepts described in the present application can be modified and varied over a tremendous range of applications, and accordingly the scope of patented subject matter is not limited by any of the specific exemplary teachings given.

For example, as will be obvious to those of ordinary skill in the art, other circuit elements can be added to, or substituted into, the specific circuit topologies shown.

The microprocessor of the presently preferred embodiment can less preferably be replaced by gate array, PLA, or other programmable or programmed logic.

The specific hardware configuration which couples the oscillators to coins in the chute can also be varied. For example, smaller coils, higher frequencies, and/or magnetic-field-shaping techniques can be used to get higher spatial resolution.

While the disclosed inventions are particularly advantageous in parking meters, they are also applicable to a variety of different applications whenever a paid timing function is to be utilized or whenever identification of deposited coins is required. For example, machines which vend goods or services, the disclosed inventions can also be adapted for use in automated coin counting systems.

It should also be noted that the disclosed innovative ideas are not limited to HC 11 implementations, but can also be implemented with various other logic and software and operating systems.

It should also be noted that the disclosed innovative ideas are not limited to edge-triggered sampling of the metallic content, but also may be implemented with a polling scheme. This can be particularly advantageous when using a faster microprocessor.

It should also be noted that the parameters for determining rejection of a coin can be tightened for more critical recognition applications. In particular, coin discrimination systems which include a reject mechanism can accept more incorrect rejections, since the customer gets his money back.

It should also be noted that the current implementation limits the input spatial resolution as is fixed by processor limitations. Improvements in resolution can be achieved with faster processors.

What is claimed is:

1. A coin discriminator system, comprising:

optical detector elements positioned to ascertain the position of a coin in a coin chute;

a programmed logic element, connected to receive at least one position indicator output from said optical detector elements, and to access a memory which includes coin recognition data; and an oscillator circuit which is electromagnetically coupled to the interior of said coin chute;

wherein said programmed logic element is programmed to sample a frequency measurement from said oscillator circuit at a position determined by said optical detector elements, and to look up coin identification data in said memory, using said frequency measurement as input, and to output coin identification data in dependence on data read from said memory.

2. The system of claim 1, wherein said memory is on a separate chip from said programmed logic element.

3. The system of claim 1, wherein said programmed logic element is a CMOS microprocessor.

4. The system of claim 1, wherein said coin chute is a free-fall coin chute.

5. A parking meter system, comprising:

a coin chute for reception of coins;

optical detector elements positioned to ascertain the position of a coin in said coin chute;

an oscillator circuit which is electromagnetically coupled to the interior of said coin chute;

a programmed logic element, connected to sample a frequency measurement from said oscillator circuit at a time determined by said optical detector elements; and a display, connected to be controlled by said programmed logic element, which controllably indicates expired and unexpired status;

wherein said programmed logic element is connected to compute available time in dependence on said frequency measurement, and to change said display between indication of expired and unexpired status accordingly.

6. A method for coin discrimination, comprising the steps of:

a) recognizing the presence of a coin in a coin chute;

b) after said step a), recognizing, using one or more optical detector elements, the position of said coin in said coin chute;

c) at a time determined by said position-recognizing step b), sampling a frequency measurement from a first oscillator circuit which is electromagnetically coupled to the interior of said coin chute; and d) using recognition parameters from one or more iterations of said steps b) and c), looking up said recognition parameters in a table that contains data on recognizable coin types; and e) outputting coin identification data in dependence on the result of said step d).

7. The method of claim 6, wherein said presence-recognizing step a) is performed by polling a presence-detect element until a coin is found to be present.

8. The method of claim 6, wherein said chute is a free-fall coin chute.

9. The method of claim 6, wherein said oscillator circuit is coupled to the interior of said chute through a coil in proximity to said chute.

10. The method of claim 6, wherein said optical detectors each comprise a lateral row of multiple LEDs, and said position-recognizing step identifies a moment when the obscuration of one but not all of said LEDs changes.

11. The method of claim 6, wherein said position-recognizing step is performed at least twice during passage of a single coin through said chute, and said sampling step measures the frequency of a first oscillator circuit in dependence on the timing of the first said position-recognizing step, and measures the frequency of a second oscillator circuit in dependence on the timing of the second said position-recognizing step.

12. The method of claim 6, wherein said sampling step is performed immediately upon the occurrence of said position-recognizing step.

13. A method for coin discrimination, comprising the steps of:

a) recognizing, using one or more optical detector elements, the position of a coin in a free-fall coin chute;

b) at a time determined by said recognizing step a), sampling an isolated frequency measurement from a first oscillator circuit which is electromagnetically coupled to the interior of said coin chute; and c) using recognition parameters from one or more iterations of said steps a) and b), looking up said recognition parameters in a table that contains data on recognizable coin types; and d) outputting coin identification data in dependence on the result of said step c).

14. The method of claim 13, wherein said oscillator circuit is coupled to the interior of said chute through a coil in proximity to said chute.

15. The method of claim 13, wherein said optical detectors each comprise a lateral row of multiple LEDs, and said position-recognizing step identifies a moment when the obscuration of one but not all of said LEDs changes.

16. The method of claim 13, wherein said position-recognizing step is performed at least twice during passage of a single coin through said chute, and said sampling step measures the frequency of a first oscillator circuit in dependence on the timing of the first said position-recognizing step, and measures the frequency of a second oscillator circuit in dependence on the timing of the second said position-recognizing step.

17. The method of claim 13, wherein said position-recognizing step is performed by polling a presence-detect element until a coin is found to be present.

18. The method of claim 13, wherein said sampling step is performed immediately upon the occurrence of said position-recognizing step.

* * * * *